United States Patent [19]

Le-Carpentier et al.

[11] Patent Number: 4,672,758

[45] Date of Patent: Jun. 16, 1987

[54] DEVICE FOR DISPLAYING ARTWORK

[76] Inventors: Alex Le-Carpentier, Sandy Lodge Bull Pond Lane, Dunstable Bedfordshire; Brian Davis, No. 1 Lancotbury Close, Totternhoe Bedfordshire, both of England

[21] Appl. No.: 745,675

[22] Filed: Jun. 17, 1985

[30] Foreign Application Priority Data

Jun. 15, 1984 [GB] United Kingdom ..... 8415249

[51] Int. Cl.[4] ..... G09F 1/12

[52] U.S. Cl. ..... 40/152.1; 40/10 R; 40/16.4

[58] Field of Search ..... 40/152, 152.1, 10, 16.4, 40/10 R, 16, 584

[56] References Cited

U.S. PATENT DOCUMENTS

| | | | |
|---|---|---|---|
| 653,672 | 7/1900 | Goodwin | 40/16.4 |
| 1,419,301 | 6/1922 | Palmer | 40/16.4 |
| 1,934,532 | 11/1933 | Hallowell et al. | 40/152.1 |
| 2,162,025 | 6/1939 | McClaughry | 40/152.1 |
| 2,492,411 | 12/1949 | Barnes et al. | 40/152.1 |
| 2,860,437 | 11/1958 | Carroll | 40/152 |
| 2,954,630 | 10/1960 | Hull | 40/152.1 |
| 3,161,975 | 12/1964 | McMillan | 40/152 |
| 3,384,987 | 5/1968 | Prechtl | 40/152.1 |
| 3,597,869 | 8/1971 | Ruyle | 40/152.1 |
| 3,783,543 | 1/1974 | Memgreen | 40/152 |

FOREIGN PATENT DOCUMENTS

| | | | |
|---|---|---|---|
| 461045 | 3/1945 | United Kingdom | 40/152 |
| 568168 | 3/1945 | United Kingdom | 40/152 |

*Primary Examiner*—Gene Mancene
*Assistant Examiner*—Wenceslao J. Contreras
*Attorney, Agent, or Firm*—Darby & Darby

[57] ABSTRACT

One section (1) of a rectangular frame is releasably secured to the remainder of the frame, in which a backing board (7) is located. When the device is fixed to a site location, the said one section (1) remains removable without damaging the site location, so as to allow a sheet (8) of artwork to be inserted into the frame in a direction parallel to the backing board (7). The artwork sheet (8) projects at least partly beyond the edge of the backing board (7) adjacent the removable section (1) so as to be grippable to facilitate removal of the artwork sheet (8).

10 Claims, 2 Drawing Figures

DEVICE FOR DISPLAYING ARTWORK

BACKGROUND OF THE INVENTION

1. Field of Invention

This invention relates to a device for displaying a sheet of artwork such as a print, poster, advertising material, photograph, or any other material which may be inserted in a picture frame.

2. Prior Art

Conventionally, framed artwork is placed, with or without a mount or mounts, on a backing board which is then fixed in a picture frame, to which a transparent sheet of glass or other material may also be fixed. The artwork cannot be removed and the existing frame reused with new artwork without removing the frame from the site location and without separating the frame and the backing board.

SUMMARY OF INVENTION

The present invention provides a device for displaying a sheet of artwork, comprising a rectangular frame having four sections, one of which is releasably secured to the remainder of the frame, a backing board located in the frame, and means for fixing the device to a site location, the said one section being removable without damaging the site location, so as to allow the sheet of artwork to be inserted in a direction parallel to the backing board.

The artwork is thus exchangeable without removing the frame and backing board from the site location and without removing the entire frame from the backing board.

Preferably, the sheet of artwork, when inserted, projects at least partially beyond the edge of the backing board (and transparent sheet, if present) adjacent the removable section. The sheet may project at one point, at a number of points, or along the whole edge. The sheet of artwork can thus easily be removed by gripping the projecting part of the sheet and pulling it parallel to the backing board.

The sheet of artwork may be provided with a mount or mounts. The size of the frame and backing board (and transparent sheet, if present) in relation to the size of the sheet of artwork, including mount(s) when used, determines the correct alignment of the artwork.

Both ends of the removable section of the frame are preferably provided with guide means for locating that section in relation to the adjacent sections. The guide means preferably fit in guideways in the adjacent sections, preferably behind the backing board; the fit is preferably such that the section is held firmly yet releasably, without any need for releasable fixings such as screws.

Site location fixing brackets may be positioned at any suitable point(s) along at least two of the other frame sections. Holes in the backing board are preferably provided aligned with the fixing brackets (if present) to allow fixing of the backing board to the site location (e.g. a wall).

There are many ways of ensuring that removal of the releasably secured frame section does not damage the site location. In general terms the removable section should be spaced from the site location. This can be achieved, for example, by spacing the frame and/or the backing board from the site location. In one embodiment, one or more adhesive pads or other spacing means are strategically positioned on the frame and/or on the backing board. Alternatively or additionally, the frame or the backing board may be of suitably modified shape, e.g. the central area of the rear side of the backing board may be raised so that the periphery is recessed in relation to it.

BRIEF DESCRIPTION OF DRAWINGS

The invention will be described further, by way of example, with reference to the accompanying drawings, in which.

DETAILED DESCRIPTION OF PREFERRED EMBODIMENTS

The device illustrated comprises a rectangular frame having four sections 1,2,3,4. Sections 2,3, and 4 are fixed by standard means. Section 1 is not fixed but slides in and out of guideways 10 in the frame by virtue of guide means 6 attached to both ends of section 1. In fact any three of sections 1,2,3,4 may be fixed by standard means and any one section not be, the unattached section having guide means (not necessarily as shown) at both ends in order to locate into the back of the frame securely.

Figure 1:
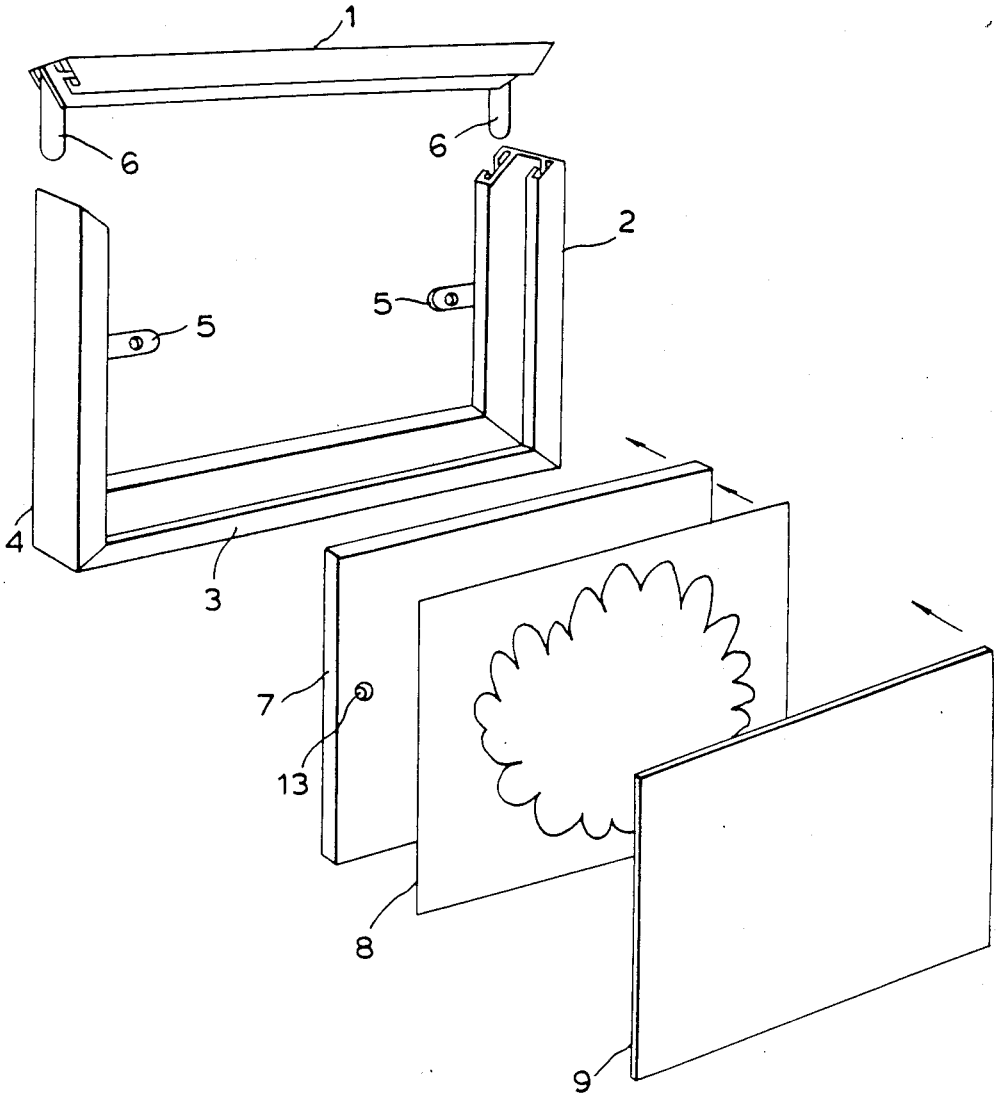
FIG. 1 is an exploded perspective view of a device for displaying a sheet of artwork.
Figure 2:
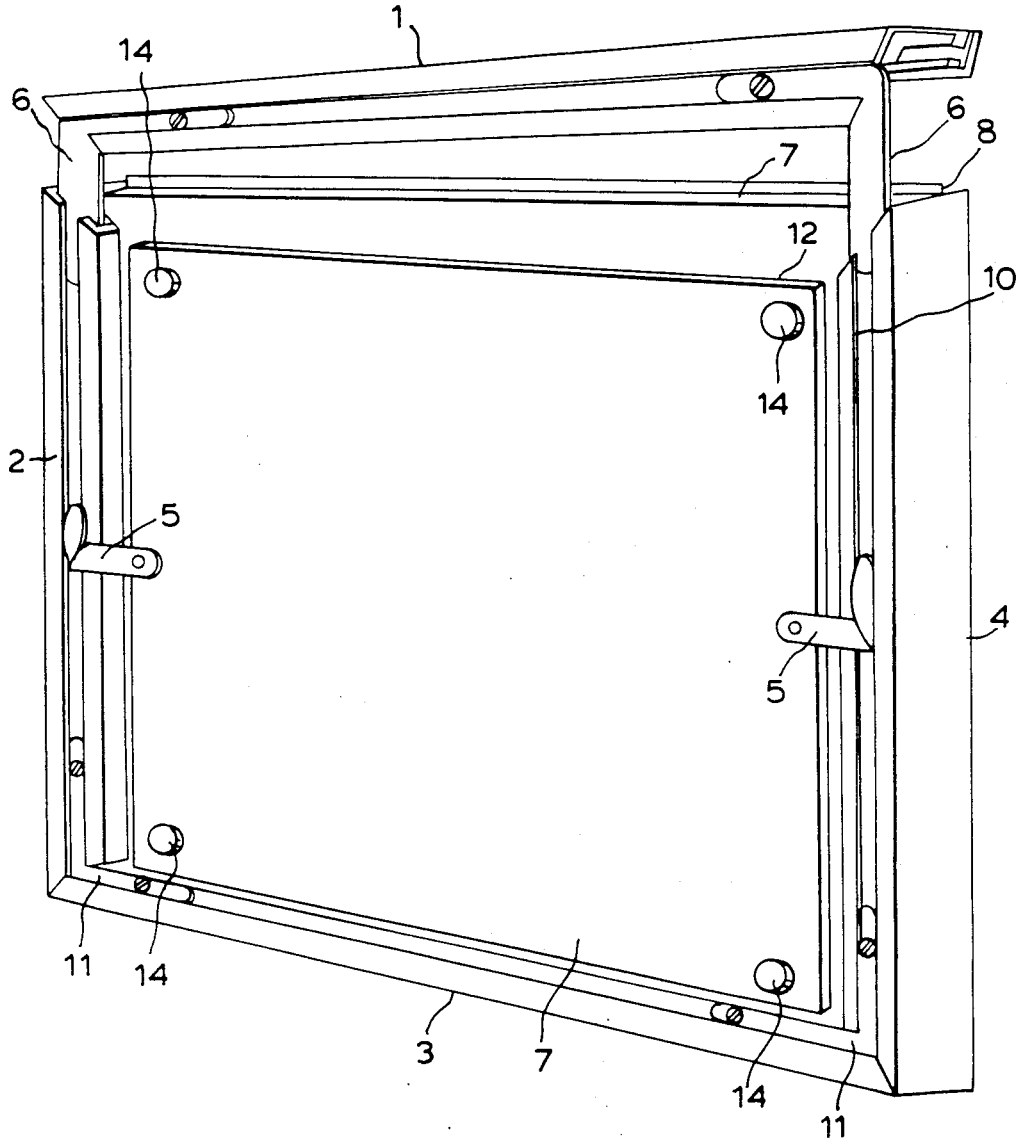
FIG. 2 is a perspective view of the device from the rear.

The size of the frame sections 1,2,3,4 when fitted together is standard for the size of artwork, e.g. advertising material, print, or other suitable material, to be framed. The size of backing board 7 and perspex, glass, or other transparent material 9 is modified so that the top, in this example, of both is cut shorter than the top edge of the artwork sheet 8 (see FIG. 2).

The backing board 7 is inserted inside frame sections 2,3, and 4 from the top in this particular example. There are two holes 13 on either side of the backing board 7, which are aligned with the holes of fixing brackets 5 when the backing board 7 has been inserted. Screws or other fixing devices are then used to fix sections 2,3,4 and board 7 to the site location by siting through holes 13 and fixing brackets 5.

In this particular example the transparent sheet 9 slides into sections 2,3, and 4 from the top, and the artwork sheet 8 is inserted parallel to and between sheet 9 and backing board 7, and is aligned in the frame merely by being inserted. Section 1 then slides into place using guide means 6 to locate in the rear of sections 2 and 4.

To change the artwork, one simply slides section 1 away from the frame; pinches the projecting edge of sheet 8 between thumb and forefinger or any other digit; removes it; inserts new artwork sheet 8 by sliding between sheet 9 and backing board 7; and replaces section 1.

It should be noted that the number of fixing brackets 5 and their shape are variable and that those illustrated are by way of example only. They can be attached to any two or all three of the sections that are fixed by standard means. The backing board 7 may have any convenient number of holes 13 in various positions aligned with the holes in fixing brackets 5 or may not have any holes 13, so that the backing board would also be removable but the three fixed sections, in this example 2,3, and 4, would fix to the site location by siting screws or other fixing means through the holes in fixing brackets 5. Brackets 11 may be modified or with certain frame mouldings be unnecessary. The fixed sections 2,3,4, in this example, would be underpinned, side pinned, or fixed by any other means.

In this particular example the backing board 7 has had a peripheral recess 12 cut out and pads 14 fitted, allowing clearance between the site location and frame itself, thus enabling section 1 to be removable without causing damage to the area where the frame is sited. The recess may not be necessary and the number of pads needed, their shape and location may vary and may or may not be necessary depending on the frame moulding used and the fittings used to fix sections 2,3, and 4, in this example, together. The top edge of backing board 7, using this example, may also be modified further, but the principle of being able to gain access to the sheet of artwork remains the same.

Thus an interchangeable print or artwork frame is provided comprising a picture frame with any three of the sections fixed together by standard means, means for releasably securing the fourth section, glass, perspex, or like material and/or backing board modified such that an insert can be placed removably between the two (or removably between the frame and backing board if no glass, perspex, or like material is used) with the frame and backing board or frame only are fixed to the site location prior to attaching the fourth section and that the fourth section is removably attachable without damaging site location.

We claim:

1. A device for displaying a sheet of artwork, comprising a backing board arranged to support substantially the whole of the sheet of artwork, a transparent sheet in front of the backing board, the sheet of artwork being between the backing board and the transparent sheet, a rectangular frame surrounding the backing board and the transparent sheet, the frame having four sections, one of which is releasably secured and removable from the remainder of the frame so as to allow the sheet of artwork to be inserted in a direction parallel to the backing board, and means for rigidly fixing the device to a site location and for spacing the frame from the site location so that said one section can be removed without damaging the site location when said device is rigidly fixed to said site location, the sheet of artwork projecting beyond at least part of the edge of the backing board adjacent said one section so as to be grippable, in order to facilitate selective removal of the sheet of artwork.

2. A device as claimed in claim 1 the sheet of artwork projecting beyond at least part of the edge of the transparent sheet adjacent said one section.

3. A device as claimed in claim 1, in which the means for rigidly fixing the device to the site location comprise means for rigidly fixing the frame and the backing board to the site location.

4. A device as claimed in claim 3, further comprising fixing brackets on said frame and in which said backing board further comprises holes aligned with said fixing brackets.

5. A device as claimed in claim 1, in which said one section has guide means which fit in guideways in the adjacent sections of said frame, said guideways being located in the rear of the frame, behind the backing board.

6. A device as claimed in claim 5, in which the guide means fit in the guideways in such a manner as to be held firmly yet releasably.

7. A device as claimed in claim 1, further comprising pads for spacing the frame from the site location.

8. A device as claimed in claim 7, in which the pads are mounted on the backing board.

9. A device as claimed in claim 1, in which the periphery of the rear side of the backing board is recessed so that the central area of the rear side of the backing board is raised away from the frame.

10. A device as claimed in claim 1, in which the transparent sheet is removable when said one section is removed.

* * * * *